US008584589B2

(12) United States Patent
Carlson et al.

(10) Patent No.: US 8,584,589 B2
(45) Date of Patent: Nov. 19, 2013

(54) DEHYDRATED, PULP-BASED PROJECTILE

(75) Inventors: Gabriel Carlson, Los Angeles, CA (US); Hanjin Park, Los Angeles, CA (US); Michael Bernstein, Hermosa Beach, CA (US)

(73) Assignee: JAKKS Pacific, Inc., Malibu, CA (US)

( * ) Notice: Subject to any disclaimer, the term of this patent is extended or adjusted under 35 U.S.C. 154(b) by 357 days.

(21) Appl. No.: 12/899,442

(22) Filed: Oct. 6, 2010

(65) Prior Publication Data

US 2011/0244996 A1 Oct. 6, 2011

Related U.S. Application Data

(60) Provisional application No. 61/340,740, filed on Mar. 18, 2010.

(51) Int. Cl.
*F42B 8/00* (2006.01)

(52) U.S. Cl.
USPC ..... 102/502

(58) Field of Classification Search
USPC ..... 102/502; 162/382, 387, 388, 389, 218, 162/202; 264/571, 101, 297.1, 345, 87, 153
See application file for complete search history.

(56) References Cited

U.S. PATENT DOCUMENTS

| | | | | |
|---|---|---|---|---|
| 264,100 | A * | 9/1882 | Prescott | 264/153 |
| 1,879,555 | A * | 9/1932 | Simmons | 264/153 |
| 3,970,516 | A * | 7/1976 | Barkel et al. | 162/382 |
| 5,241,944 | A | 9/1993 | Rappaport | |
| 5,448,984 | A | 9/1995 | Brovelli | |
| 6,190,151 | B1 * | 2/2001 | Hunt | 425/80.1 |
| 7,074,302 | B2 * | 7/2006 | Renck et al. | 162/227 |
| 7,507,315 | B1 * | 3/2009 | Seelenbinder-Apke et al. | 162/386 |
| 7,878,787 | B2 * | 2/2011 | Nilsson et al. | 425/85 |
| 2003/0111201 | A1 * | 6/2003 | Sato et al. | 162/382 |
| 2005/0121163 | A1 * | 6/2005 | Renck et al. | 162/218 |
| 2005/0150624 | A1 * | 7/2005 | Toh et al. | 162/218 |
| 2008/0000464 | A1 * | 1/2008 | Campo et al. | 124/71 |

* cited by examiner

*Primary Examiner* — Jonathan C Weber
(74) *Attorney, Agent, or Firm* — Tope-McKay & Associates

(57) ABSTRACT

A dehydrated, pulp-based projectile is described. The projectile is pulp material that is molded and dehydrated into a projectile shape to form the dehydrated, pulp-based projectile. In operation, the pulp-based projectile can be positioned within the bullet chamber (e.g., gun clip) of a toy gun and then rehydrated. For example, the toy gun or bullet chamber can be dipped in water, which would cause the projectile to absorb the water and soften. An advantage to being pulp based is that the projectile is more solid than foam and, as such, generally shoots straighter and further than foam. However, when rehydrated, the projectile has the propensity to stick to its target as it becomes pliable and sticky through rehydration.

3 Claims, 13 Drawing Sheets

DEHYDRATED, PULP-BASED PROJECTILE

PRIORITY CLAIM

This is a non-provisional application of U.S. Provisional Application No. 61/340,740, filed on Mar. 18, 2010, entitled, "Air-powered projectile shooter and pulpous projectiles for shooting therefrom."

BACKGROUND OF THE INVENTION (1) Field of Invention

The present invention relates to a toy projectiles and, more particularly, to a pulp-based material that is dehydrated to form a toy projectile.

(2) Description of Related Art

Toy projectiles have long been known in the art. Toy projectiles are often expelled by toy guns to simulate the firing of a weapon. To reduce injury, several toy guns have been created to fire "soft" projectiles. The soft projectiles are presumably softer and less dangerous than their metallic counterparts. By way of example, several toy companies sell toy guns that shoot plastic or foam bullets. Both the plastic and foam bullets do not possess the mass of a real metallic bullet and, therefore, are less dangerous.

An advantage of plastic bullets is that they are solid and typically smaller than foam bullets and, as such, are less influenced by wind resistance than foam bullets. In other words, after being fired by a toy gun, a solid and plastic projectile is more likely than a porous projectile (i.e., the foam bullet) to shoot straight. A disadvantage to such plastic bullets is that they are solid and, although softer than metal, can still cause injury. Additionally, because they are typically solid, such plastic bullets do not stick to their target and readily "bounce off" of the target. Alternatively, a foam bullet is much softer than a plastic bullet which reduces the risk of injury from such a projectile. However, as noted above, the foam bullet is subject to being influenced by air currents and, as such, does not shoot straight (or as far) as a plastic bullet. As was the case with a plastic bullet, a foam bullet also does not stick to its target.

In order to stick to a target, some toy projectiles have been formed to be tipped with a suction cup or a hook/loop fastener. While operable for sticking to the target, the suction cup requires a smooth surface to stick to, while the projectile having a hook/loop fastener requires a corresponding hook/loop fastener affixed to the target surface. In both cases, the use of the suction cup or hook/loop fastener increase air resistance and, thereby, decrease the distance that such a projectile can be propelled.

Thus, a continuing need exists for a soft projectile that is safer than a plastic bullet, that is less influenced by air current than a foam bullet or tipped projectile, and that is capable of sticking to its target.

SUMMARY OF INVENTION

While considering the failure of others to make use of all of the above components in this technology space, the inventor unexpectedly realized that a dehydrated pulp-based projectile would increase safety while being less influenced by air current. Also, it was unexpectedly realized that such a pulp-based projectile, when rehydrated, would be capable of making an air tight seal in a bullet chamber that includes safety projections and, when fired, stick to a target.

Thus, the present invention is directed to a dehydrated, pulp-based projectile. The projectile is pulp material that is molded and dehydrated into a projectile shape to form the dehydrated, pulp-based projectile. In operation, the pulp-based projectile can be positioned within the bullet chamber (e.g., gun clip) of a toy gun and then rehydrated. For example, the toy gun or bullet chamber can be dipped in water, which would cause the projectile to absorb the water, soften, and expand. An advantage to being pulp based is that the projectile is more solid and smaller than foam and, as such, generally shoots straighter and further than foam. However and as noted above, when rehydrated, the projectile has the propensity to stick to its target as it becomes pliable and sticky through rehydration.

Finally, as can be appreciated by one in the art, the present invention also comprises a method for forming and using the dehydrated, pulp-based projectile described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1A:
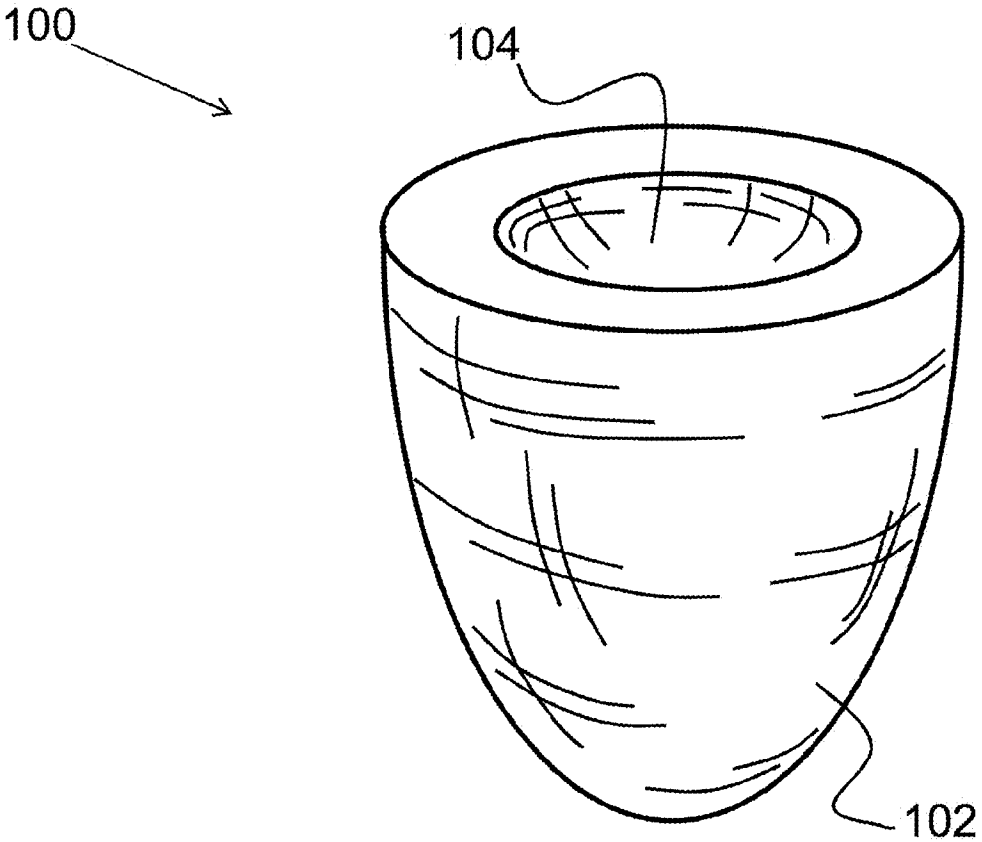
FIG. 1A is an illustration of a dehydrated, pulp-based projectile according to the present invention.

The present invention relates to a toy projectiles and, more particularly, to a pulp-based material that is dehydrated to form a toy projectile. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

As described above, toy projectiles have long been known in the art. However, toy projectiles of the prior art are known to bounce off of their target, are influenced by air currents, and/or can present a risk of injury. Thus, the present invention improves upon the prior art by providing a dehydrated, pulp-based projectile that, when rehydrated, is soft and capable of sticking to its target.

FIG. 1A depicts a pulp-based projectile 100 according to the present invention. The projectile 100 is formed of a dehydrated pulp material, a non-limiting example of which includes paper. Thus, in one aspect, the projectile 100 is formed of dehydrated paper-pulp. Other non-limiting examples of suitable materials for forming the projectile include wood pulp, recycled or virgin pulp, bleached or natural pulp, colored pulp, a starch-based material (e.g., peanuts), or a fiber/filler with a binding material such as starch or water-based glue. Additional non-limiting examples include a rice-based material, dehydrated gels, a hydro-polymer (similar to the absorbent polymer material used in a diaper), and a sponge material that is compressed and dehydrated.

As can be appreciated by one skilled in the art, the projectile 100 can be formed in a variety of shapes, non-limiting examples of which include being round, or shaped as that depicted in FIG. 1A. As shown, the projectile can include a rounded tip portion 102 and a hollowed base 104. The hollowed base 104 is a depression (i.e., concave) formed in the back end of the projectile 100.

In operation, the pulp-based projectile 100 can be positioned within the bullet chamber (e.g., gun clip) of a toy gun and then rehydrated. For example, the toy gun or bullet chamber can be dipped in water, which would cause the projectile to absorb the water, soften, and expand. An advantage to being pulp based is that the projectile 100 is more solid than foam and, as such, generally shoots straighter and further than foam. However, when rehydrated, the projectile 100 has the propensity to stick to its target as it becomes pliable and sticky through rehydration.

Figure 1B:
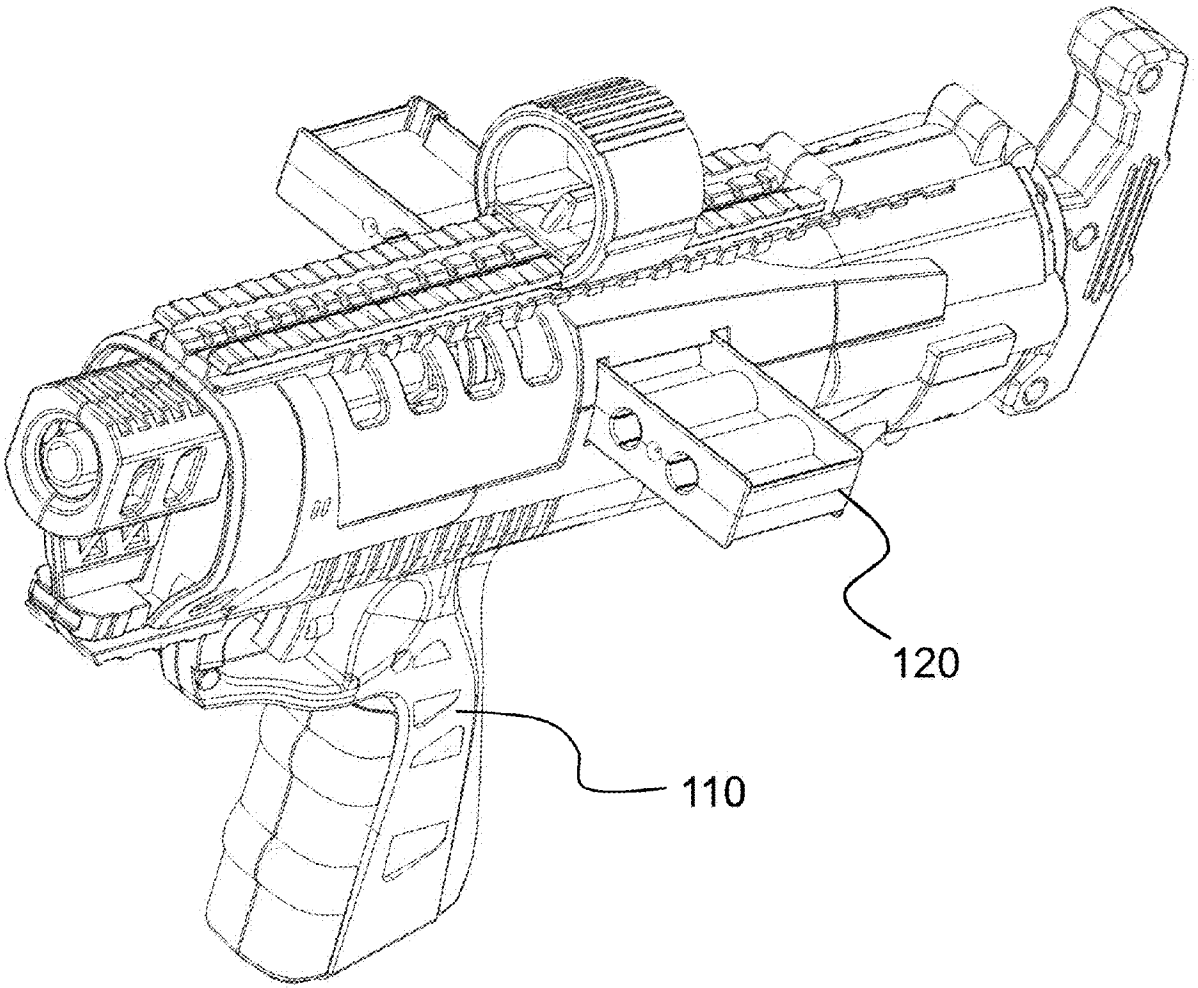
FIG. 1B is an illustration of an air-powered toy gun capable of propelling the pulp-based projectile of the present invention.
Figure 1C:
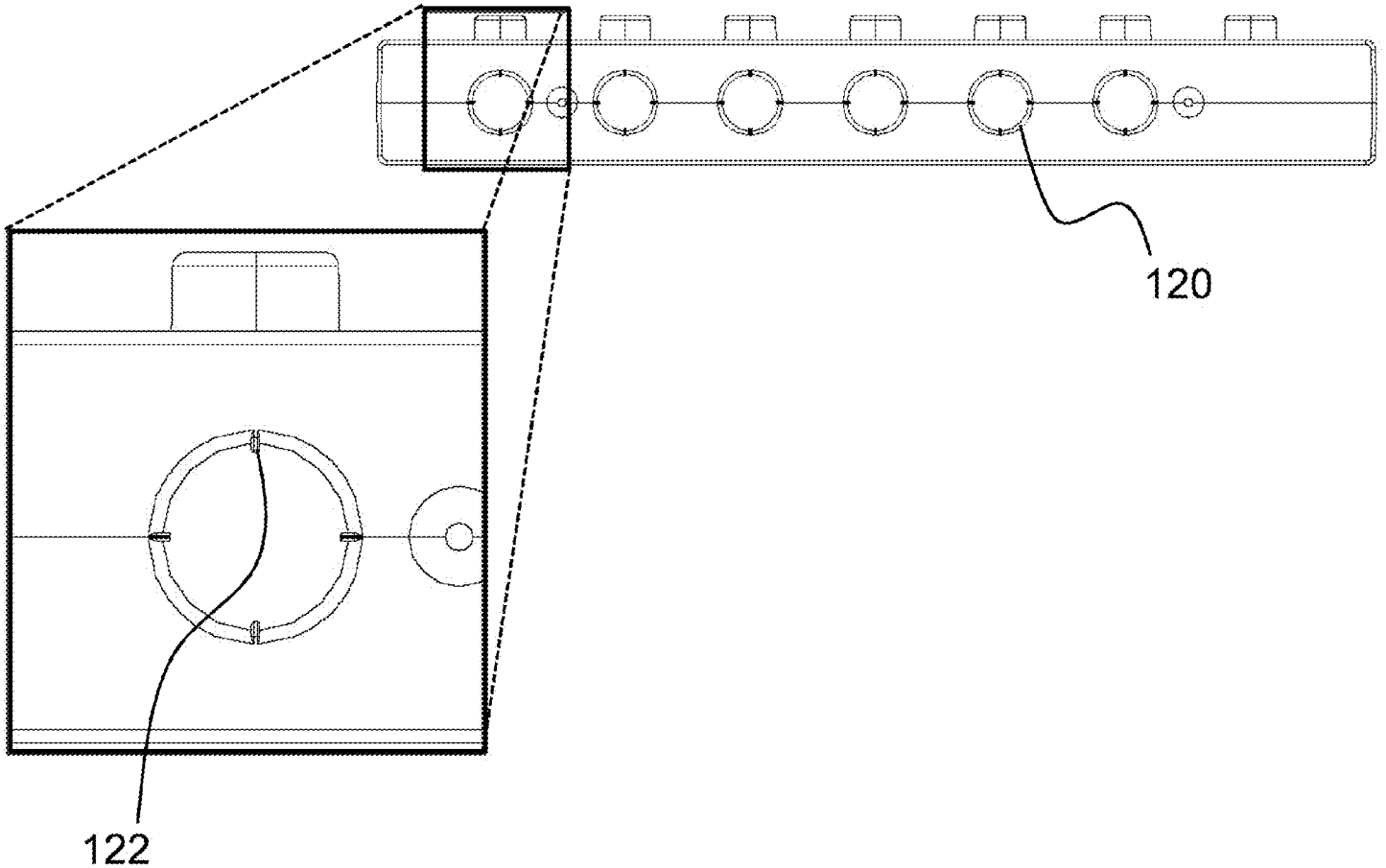
FIG. 1C is an illustration of a bullet chamber that is capable of accommodating the pulp-based projectile of the present invention.

Additionally, the pulp-based projectile 100 according to the present invention can be used with an air-powered toy gun and propelled from the toy gun. As a non-limiting example, FIG. 1B depicts an air-powered toy gun 110 that is capable of propelling the pulp-based projectile and the corresponding bullet chamber 120. FIG. 1C illustrates a close-up view of an example bullet chamber 120 that is capable of accommodating the pulp-based projectile. As shown, the bullet chamber 120 (i.e., bullet clip) can be formed to include projections 122 running therethrough. The projections 122 are used as a safety mechanism to prevent a user from shooting unsafe projectiles. For example, it would be undesirable to allow a user to use a toy gun to shoot marbles or other hard items which could potentially cause harm. As such, in this case, the projections 122 prevent another round item from being positioned within the chamber 120 and creating an air tight seal. Because the toy gun is air powered, if an air seal is not maintained, it is unlikely that the toy gun can expel the projectile. However, as used with the present invention and because the pulp-based projectile is dehydrated and rehydratable, when the pulp-based projectile is positioned within the chamber 120 and dipped into water, the projectile becomes rehydrated, pliable, and expands. As such, in operation, the rehydrated pulp-based projectile expands around the projections 122 to create an air tight seal within the chamber 120.

As described herein, the projectile 100 is a pulp-based projectile. The pulp-based projectile can be formed using any suitable technique for creating such a dehydrated, pulp-based item. For further understanding, FIGS. 2 through 11 illustrate a non-limiting example of such a technique for producing a dehydrated, pulp-based projectile.

Figure 2:
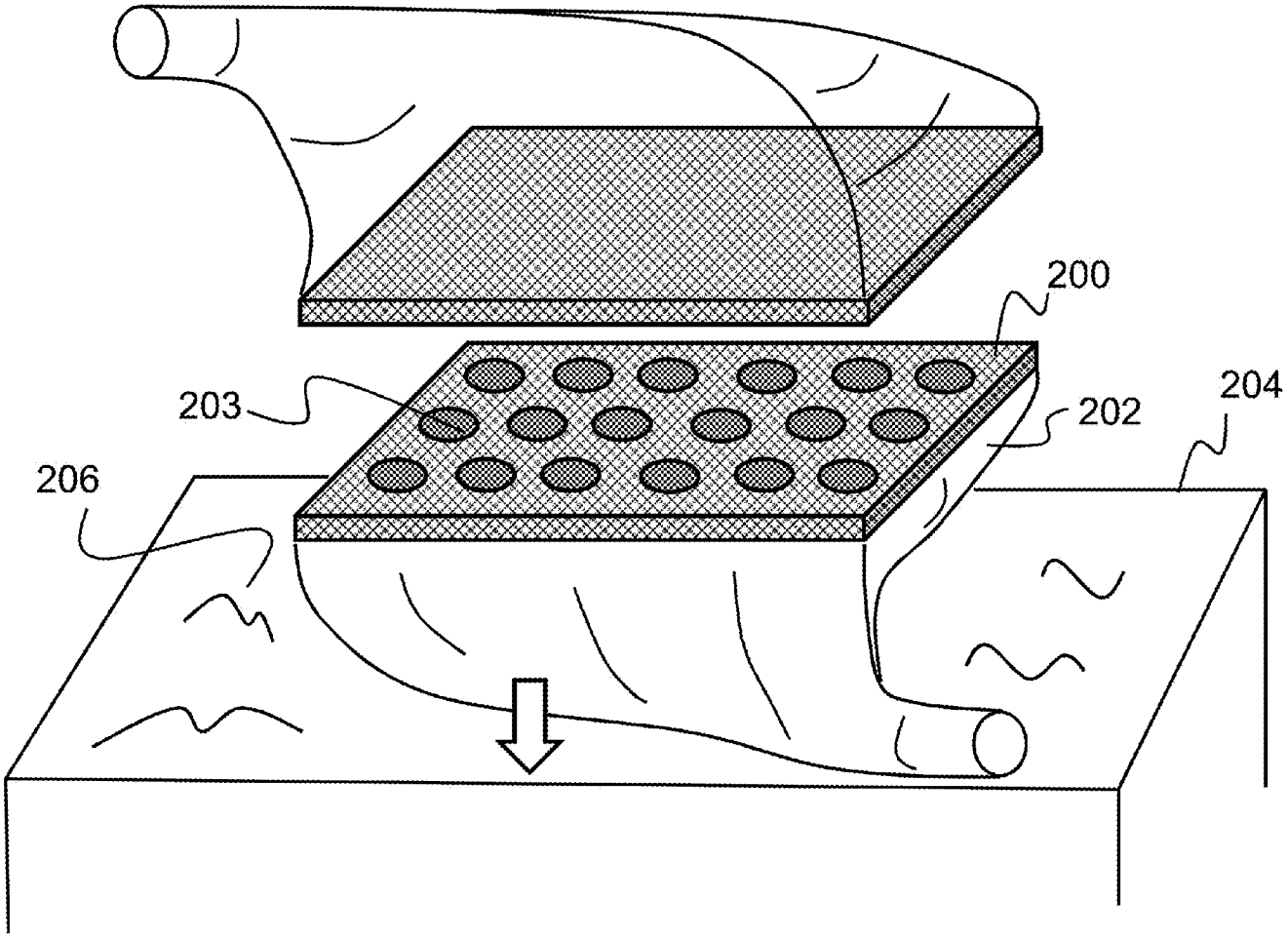
FIG. 2 is an illustration of mesh mold for forming the pulp-based projectile.
Figure 3:
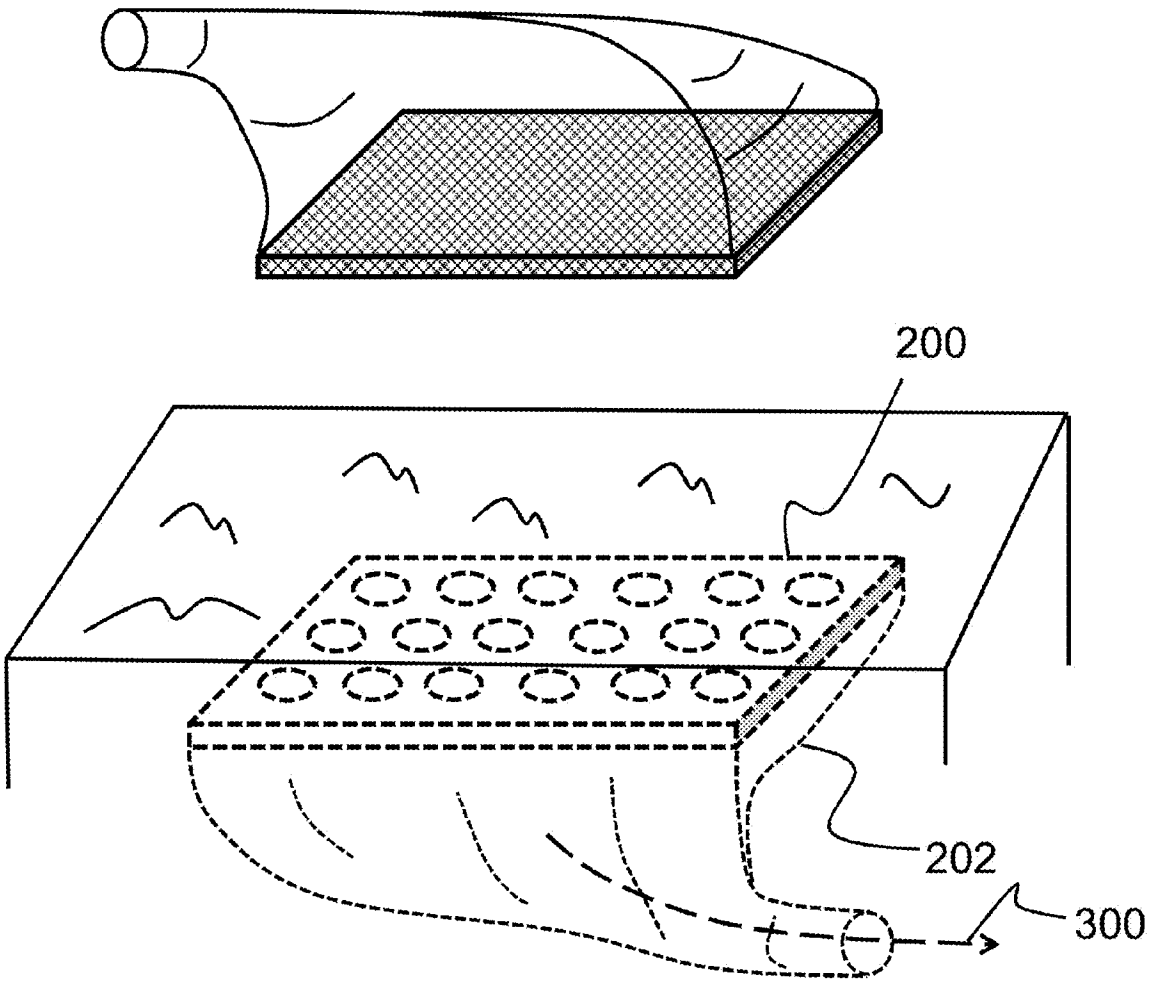
FIG. 3 is an illustration of the mesh mold being introduced into a container of pulp solution.

For example, FIG. 2 depicts a mesh mold 200 (or any other mold system with vacuum holes) with a vacuum system 202 attached thereto. The mesh mold 200 includes a plurality of depressions 203 that are formed in the desired shape (i.e., the shape of the projectile). The mesh mold 200 can be dipped into a container 204 (e.g., vat) filled with a pulp solution (e.g., paper pulp). As shown in FIG. 3, a vacuum 300 is then applied (through the vacuum system 202) to the mesh mold 200, which draws the pulp into the mesh mold 200.

Figure 4:
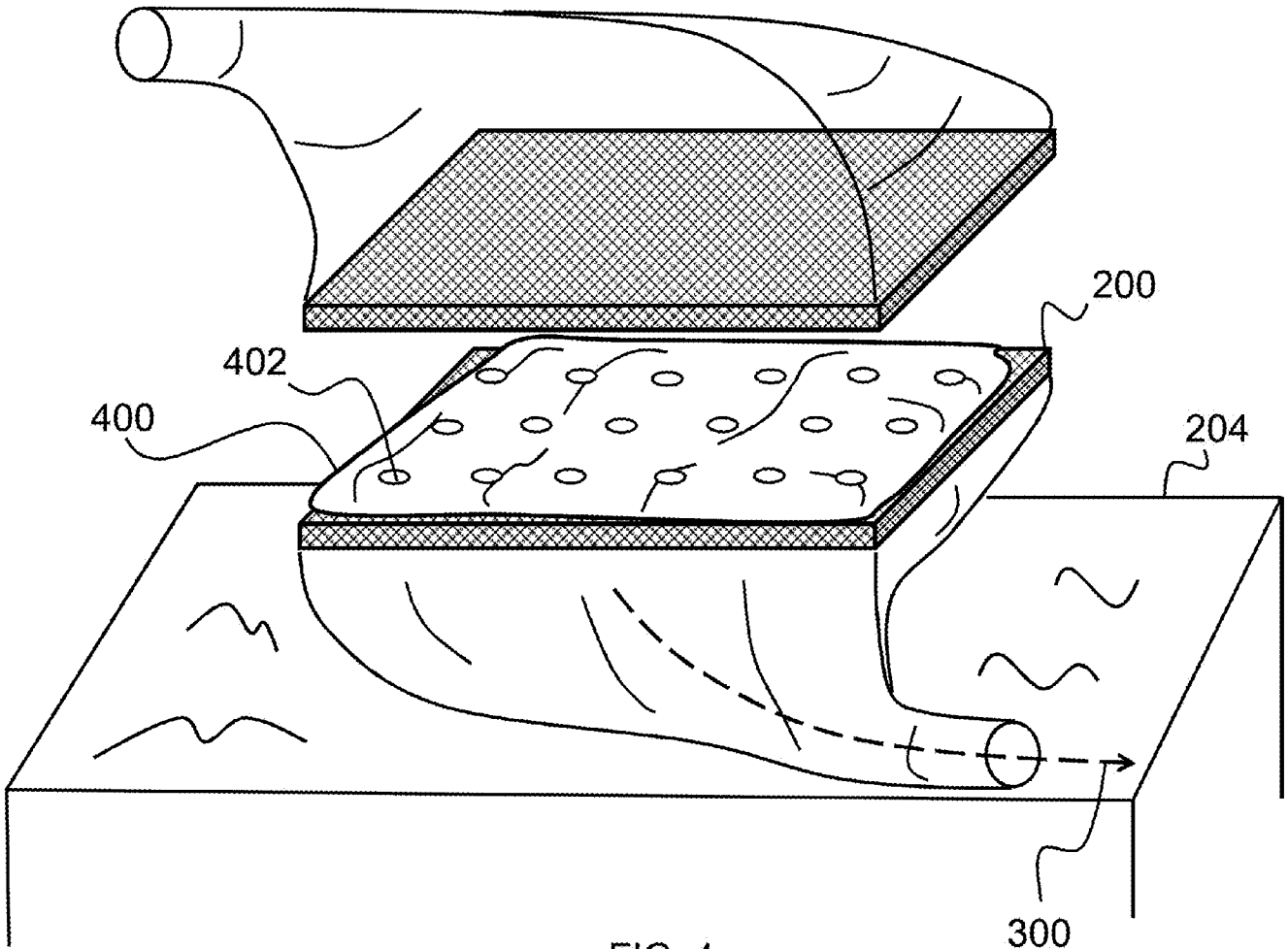
FIG. 4 is an illustration depicting the mesh mold as removed from the container, leaving a pulp-slush on the mesh mold that is vacuumed to form a semi-dehydrated pulp plate.

As shown in FIG. 4, the mesh mold 200 is then removed from the container 204, leaving a pulp-slush 400 coating the mesh mold 200. The vacuum 300 can be applied to draw the liquid from the pulp-slush 400 and further dehydrate the pulp-slush 400 to form a semi-dehydrated pulp plate (shown in FIG. 6). It should be noted that as the vacuum 300 draws the pulp-slush 400 into each of the depressions (depicted as element 203 in FIG. 2), it causes a dimple 402 to form on the surface of the pulp-slush 400. As can be appreciated by one skilled in the art, the dimple 402 serves as the hollowed base that is formed in the back end of the projectile (as depicted in FIG. 1).

Figure 5:
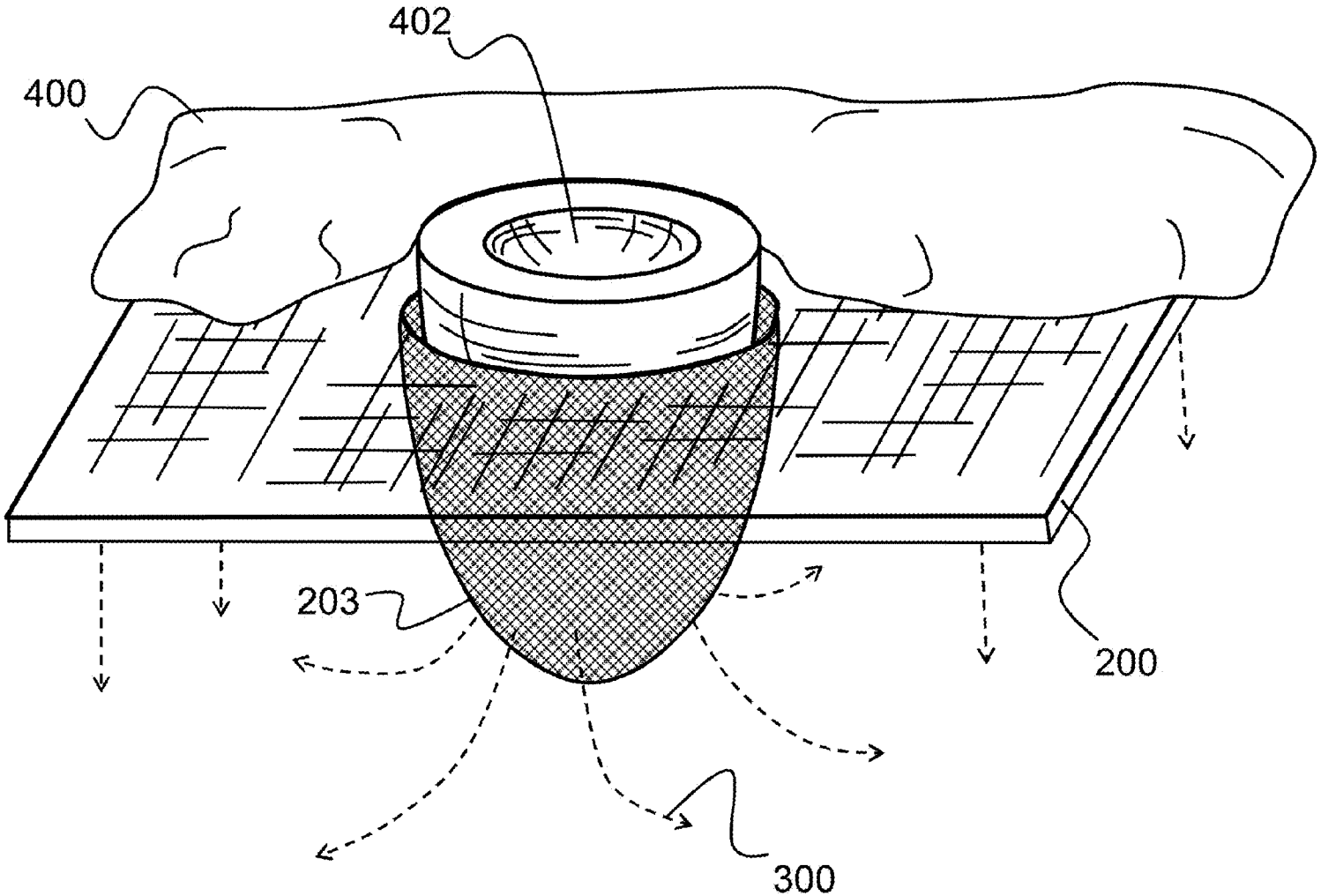
FIG. 5 is a close-up view of the pulp-slush being pulled into a depression of the mesh mold via a vacuum.
Figure 6:
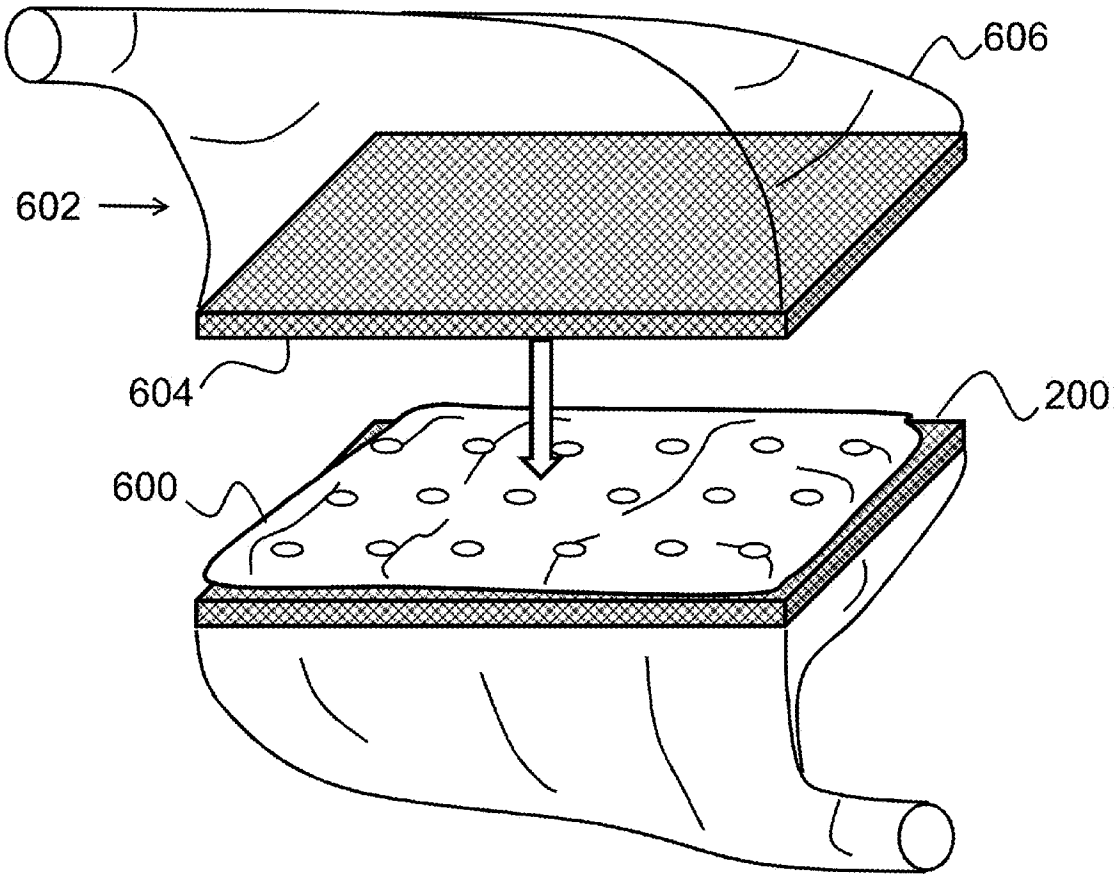
FIG. 6 is an illustration depicting a vacuum removal system being applied to the semi-dehydrated pulp plate.

For further understanding, FIG. 5 is a close-up view of the pulp-slush 400 being pulled into a depression 203 of the mesh mold 200 via the vacuum 300. Also shown is the dimple 402 that is formed as the vacuum 300 draws the pulp-slush 400 into the depression 203.

As noted above and as depicted in FIG. 6, after the vacuum has been applied, a semi-dehydrated pulp plate 600 remains affixed to the mesh mold 200. The semi-dehydrated pulp plate 600 is then removed from the mesh mold 200 using any suitable removal technique, a non-limiting example of which includes employing a vacuum removal system 602. The vacuum removal system 602 includes a mesh plate 604 and a vacuum housing 606 attached thereto.

Figure 7:
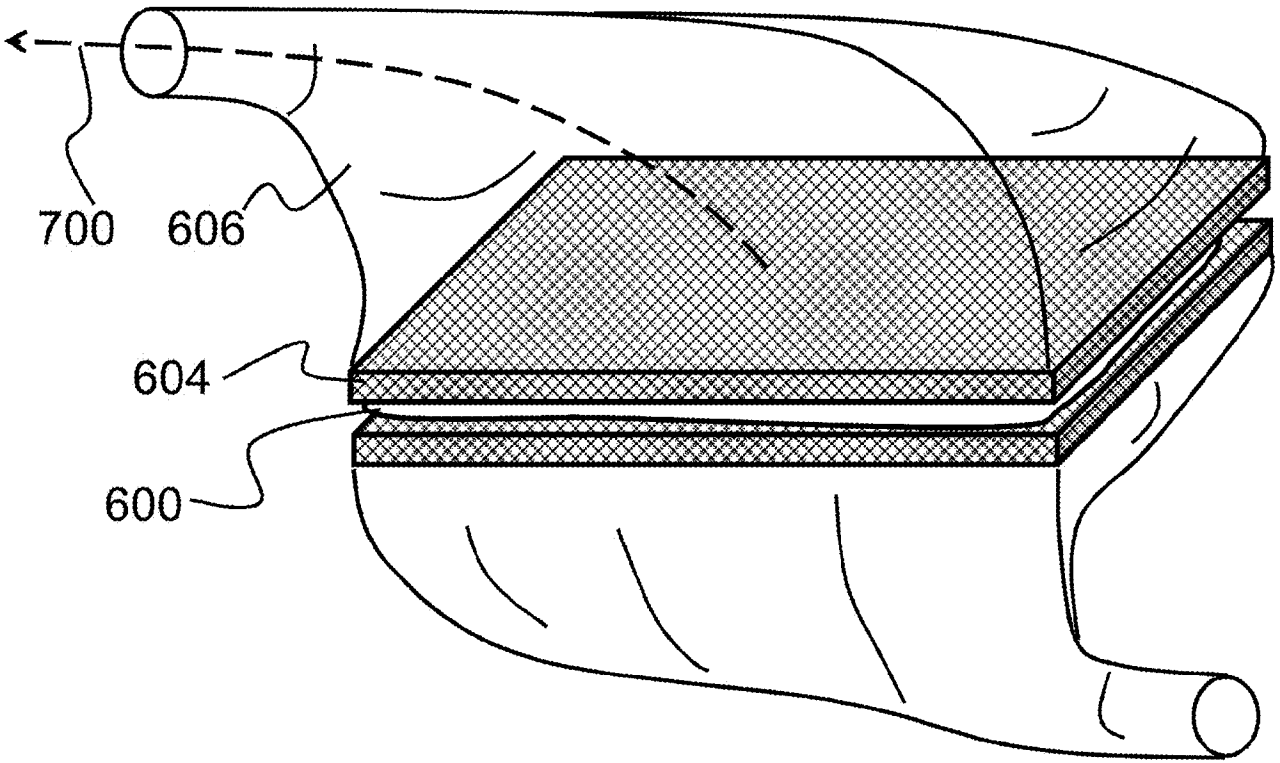
FIG. 7 is an illustration depicting the vacuum removal system being positioned against the semi-dehydrated pulp plate.
Figure 8:
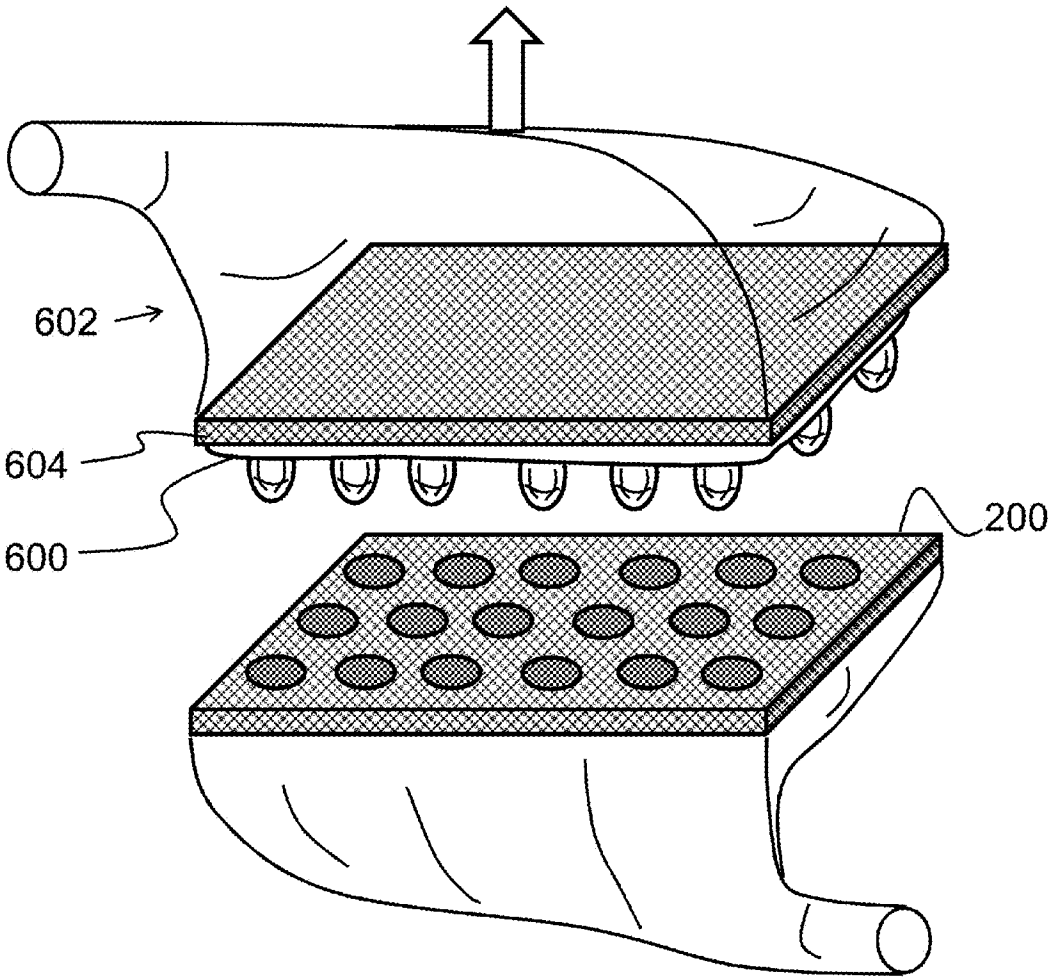
FIG. 8 is an illustration depicting the semi-dehydrated pulp plate being removed from the mesh mold.

In operation and as shown in FIG. 7, the mesh plate 604 is lowered onto (or otherwise pressed against) the semi-dehydrated pulp plate 600. A vacuum 700 is applied through the vacuum housing 606, which causes the semi-dehydrated pulp plate 600 to adhere to the mesh plate 604. Thus, as depicted in FIG. 8, when the vacuum removal system 602 is lifted, the semi-dehydrated pulp plate 600 is sucked into the mesh plate 604 and removed from the mesh mold 200.

Figure 9:
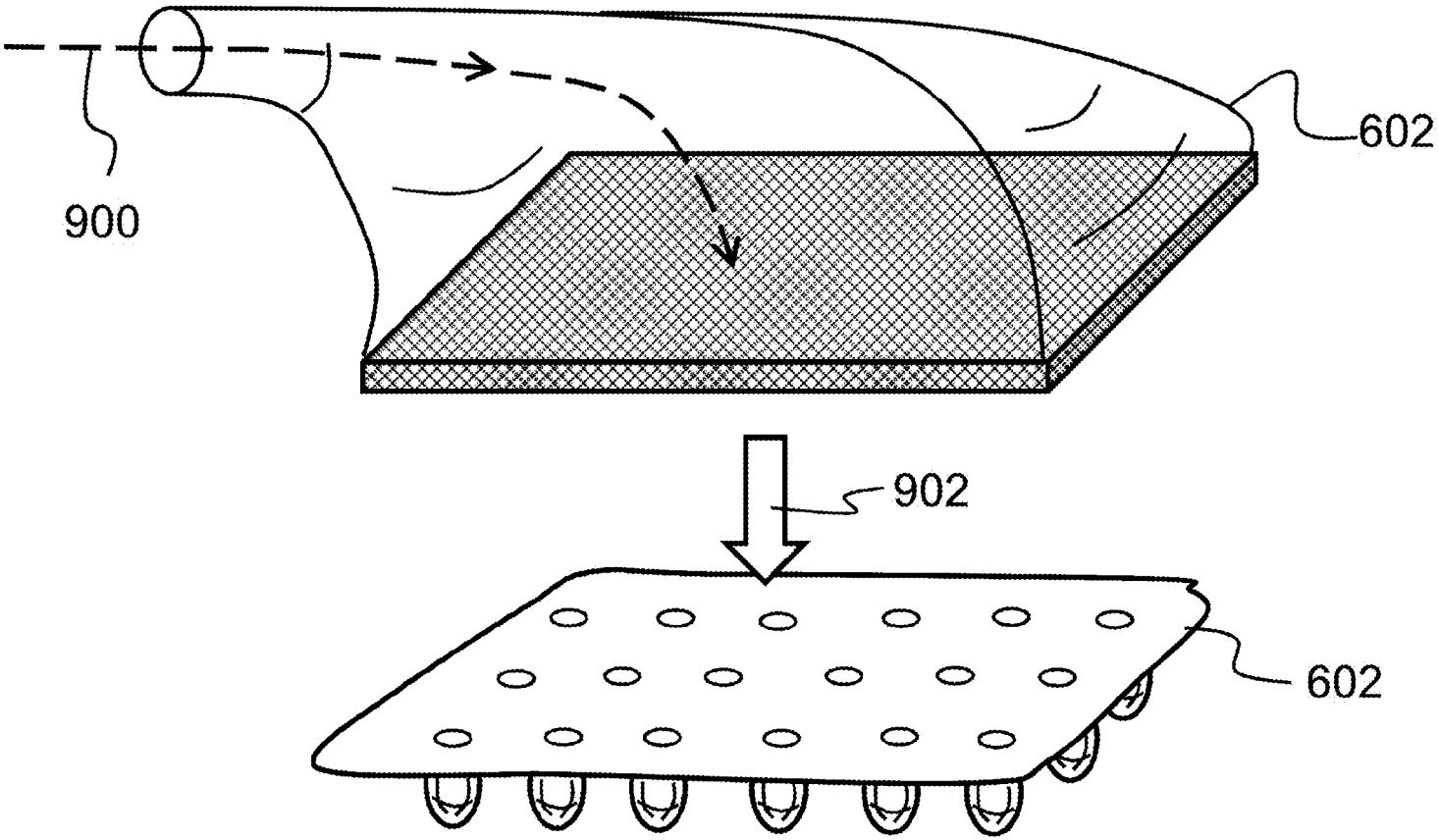
FIG. 9 is an illustration depicting the semi-dehydrated pulp plate being blown from the vacuum removal system.

The semi-dehydrated pulp plate 600 can then be removed from the mesh plate 604 using any suitable technique. As a non-limiting example and as depicted in FIG. 9, a reverse vacuum 900 (or a burst of air) can be used to blow 902 the semi-dehydrated pulp plate 600 from the vacuum removal system 602.

Figure 10:
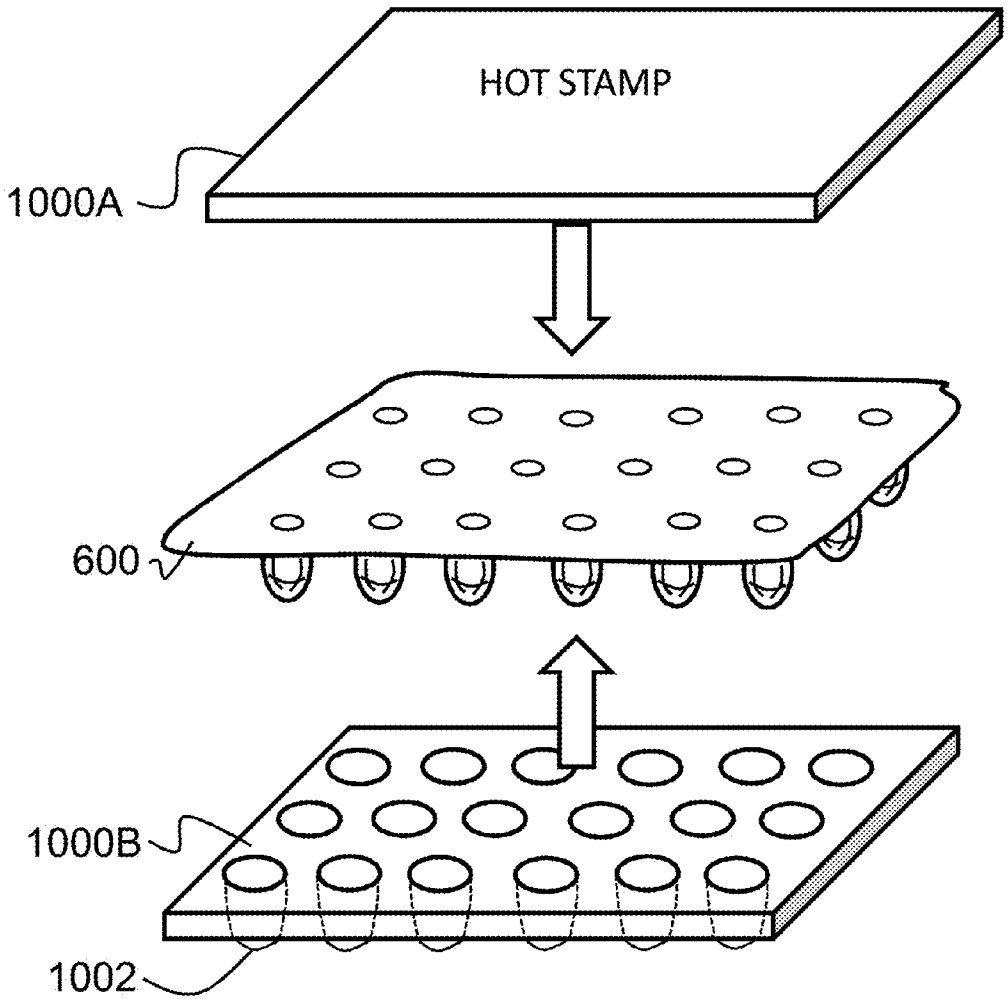
FIG. 10 is an illustration depicting a hot stamp being applied to the semi-dehydrated pulp plate to form a fully dehydrated pulp plate.

Once removed, the semi-dehydrated pulp plate 600 is fully dehydrated and straightened using any suitable dehydration technique, non-limiting examples of which include air drying, oven drying, and hot stamping. For example and as depicted in FIG. 10, a hot stamp can be applied to the semi-dehydrated pulp plate 600 to further dehydrate the plate and form the fully dehydrated pulp plate. The hot stamp can include a first hot stamp 1000A and a second hot stamp 1000B, with the pulp plate 600 sandwiched therebetween. The hot stamps 1000A and 1000B can be heated to a hot temperature to further heat and dehydrate the pulp plate 600. Additionally, the second hot stamp 1000B can be formed to accommodate the shape of the pulp plate 600 (e.g., formed with holes or cavities/depressions). For example, the second hot stamp 1000B can include cavities 1002 that are shaped to help "reform" the bullets to an even more precise and predetermined shape.

Figure 11:
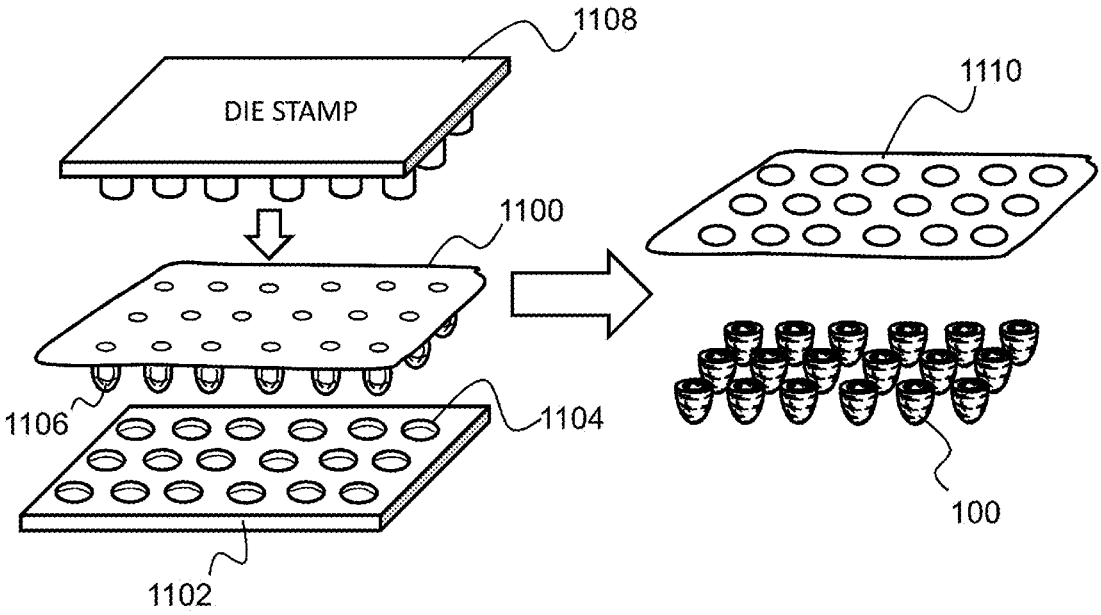
FIG. 11 is an illustration depicting a die stamp being applied to the fully dehydrated pulp plate to stamp out a plurality of dehydrated, pulp-based projectiles according to the present invention.

FIG. 11 is an illustration depicting a die stamp being applied to the fully-dehydrated pulp plate 1100 to stamp out a plurality of dehydrated, pulp-based projectiles 100. In operation, the die stamp includes a negative mold 1102 with holes 1104 formed to accommodate the protrusions 1106 formed in the fully-dehydrated pulp plate 1100. The die stamp also includes a positive mold 1108 that is pressed into the fully-dehydrated pulp plate 1100 to shear the projectiles 100 (similar in operation to a hole-punch) from the fully-dehydrated pulp plate 1100, resulting in the plurality of projectiles 100 and a remaining pulp plate 1110. The remaining pulp plate 1110 can be recycled and used again to make more pulp and resulting projectiles.

As noted above, the process depicted in FIGS. 2 through 11 is but one non-limiting example of a technique for forming a projectile according to the present invention. Additional non-limiting examples of which include molding the projectile through simple casting or slush molding. Another non-limiting example for forming the projectile is through stamping the projectile out of a sheet of pulp material or foam (e.g., similar to the action of a hole punch device that punches the circle (in this case the projectile) from the sheet).

What is claimed is:

1. A method for forming a dehydrated, pulp-based projectile, the method comprising acts of:

dipping a mesh mold into a container filled with a pulp solution;

applying a vacuum to the mesh mold to draw pulp material from the pulp solution into depressions in the mesh mold;

removing the mesh mold from the container, leaving a pulp-slush coating the mesh mold;

applying a vacuum to the mesh mold to draw liquid from the pulp-slush, forming a semi-dehydrated pulp plate;

removing the semi-dehydrated pulp plate from the mesh mold;

dehydrating the semi-dehydrated pulp plate to form a fully dehydrated pulp plate; and die stamping the fully dehydrated pulp plate to shear a plurality of projectiles from the fully dehydrated pulp plate, resulting in a plurality of projectiles and a remaining pulp plate.

2. A dehydrated, pulp-based projectile formed according claim 1.

3. The dehydrated, pulp-based projectile according to claim 1, wherein in removing the semi-dehydrated pulp plate from the mesh mold, the semi-dehydrated pulp plate is removed using a vacuum removal system having a mesh plate and a vacuum housing, such that in operation, the semi-dehydrated pulp plate is removed from the mesh mold according to the process of:

positioning the mesh plate against the semi-dehydrated pulp plate;

applying a vacuum through the vacuum housing to cause the semi-dehydrated pulp plate to adhere to the mesh plate;

lifting the vacuum removal system to remove the semi-dehydrated pulp plate from the mesh mold; and applying a burst of air through the mesh plate to blow the semi-dehydrated pulp plate from the vacuum removal system.

* * * * *